United States Patent [19]

Whike et al.

[11] 4,217,091

[45] Aug. 12, 1980

[54] OVEN PROCESS WITH SOLVENT FREE EXHAUST

[75] Inventors: Alan S. Whike, Caledon East; Richard Dusil, Mississauga, both of Canada

[73] Assignee: B & K Machinery International Limited, Malton, Canada

[21] Appl. No.: 950,084

[22] Filed: Oct. 10, 1978

[51] Int. Cl.[2] ..... F27B 9/28; F27D 7/04

[52] U.S. Cl. ..... 432/8; 110/204; 432/21; 432/72

[58] Field of Search ..... 432/8, 21, 23, 59, 72, 432/222; 110/204

[56] References Cited

U.S. PATENT DOCUMENTS

| | | | |
|---|---|---|---|
| 1,947,548 | 2/1934 | Fruth et al. | 432/8 |
| 3,984,198 | 10/1976 | Birke et al. | 432/8 |
| 4,133,636 | 1/1979 | Flynn | 432/72 |

*Primary Examiner*—John J. Camby

[57] ABSTRACT

A method of curing a solvent based coating on a strip comprising passing the strip through oven zones, circulating hot gases in the zones to vaporize solvents and entrain them in such gases and cure the coatings, the solvents being released in high volume one zone, and in low volume in another zone, incinerating some of the gases in the zones to oxidize solvent vapors and returning them to the zones, extracting some solvent-rich gases without incineration from the high release zone and distributing them to other zones, incinerating the solvent-rich gases as they are introduced into the other zones to oxidize solvent vapors and discharge high temperature combustion gases in the zones supplying some heat for the zones and reducing solvent vapors, extracting some of the gases from some zones and introducing them into the high solvent release zone to partially replace the gases transferred, the balance being made up by upstream migration of zone gases within said oven, and exhausting some gases to atmosphere.

7 Claims, 1 Drawing Figure

OVEN PROCESS WITH SOLVENT FREE EXHAUST

The invention relates to a convection oven for the curing of coatings on a strip, such as strip sheet metal.

BACKGROUND OF THE INVENTION

Convection oven i.e. ovens in which gases are continuously circulated around to provide turbulent gas flow, are utilized for the curing of coatings on strip material such as strip sheet metal.

The circulating gases are heated so as to heat up the strip and the coating and produce a rapid baking or cure of the coating.

The solvents are vaporized in the process and are entrained in the gases. By suitable means of ventilation such solvent vapours must be kept below a certain level of concentration in the oven, in order to avoid the danger of explosion. In addition, to vent such solvent vapours untreated directly to atmosphere would cause environmental damage.

Accordingly it is the practice to provide continuous incineration of oven gases to oxidize the solvent vapours and render them harmless. In most cases such incineration is carried out in the exhaust stack from the oven, with the incinerated gases being simply exhausted directly to atmosphere. In some cases heat exchangers are employed in the stack to recover some of the heat values which would otherwise be lost up the stack.

In accordance with more modern practice however it has been found advantageous to carry out some of such incineration within the oven itself. In this way, oven atmosphere rich in solvent vapour can be transferred from one point in the oven, and then can simply be reintroduced into the oven through a zone inincinerator as solvent-free atmosphere, so providing part of the required ventilation to limit concentration of solvent vapours in the zone and providing the heat demands of the zone. One advantage is that the oven atmosphere is retained within the oven and does not have to be exhausted to atmosphere. This in turn means that less fresh air has to be introduced into the oven for the purpose of ventilation, and thereby reducing the fuel required for heating the incoming fresh air.

It has been known for some time that solvent vapours are evaporated largely in the first quarter to one third of an oven. During the remaining two thirds to three quarters of the oven, the amount of solvent vapours developed diminishes to zero so that as the strip passes through this part of the oven, the coating is simply being cured, with virtually no solvent vapours being evaporated at all.

Accordingly, the best engineering practice provides the greatest amount of "ventilation" ie. solvent free gas flow within the first quarter to one third of the oven. In this way, the solvent vapours being developed are rapidly entrained and carried away and mixed with oven gases. In this way, the concentration of such solvent vapours in the oven atmosphere is kept to within acceptable limits even in these zones of high solvent release.

Some of these solvent rich gases are transferred downstream to zones of lower or no solvent release, and in some cases, to balance this downstream gas flow, low solvent vapour gases were transferred upstream so as to maintain the ventilation within the upstream zones of high solvent release.

Zone incinerators are provided in the various zones for incinerating zone gases in each zone, and also for receiving gases transferred from other zones and incinerating them to provide solvent free high temperature gases in each zone.

In all of these systems however it has always been the practice that the gases being exhausted to atmosphere were exhausted from the zones of highest solvent release. This zone would usually be in the first one quarter to one third of the oven. In this way it was assumed that the high volume of solvent vapour in the zone of high solvent release was split between the various zone incinerators throughout the oven and the afterburner in the exhaust stack, and the latter portion, after passing through the stack afterburner could be discharged to atmosphere, substantially free of pollutants.

The extraction of solvent rich gases for incineration at the stack afterburner created serious problems. Environmental considerations require strict limits on the percentage of untreated solvent vapours in the exhausted gases being released to atmosphere. In order to maintain these limits, when supplied with relatively solvent rich oven gases, it was necessary to operate the stack afterburner at very high temperatures. Typically these temperatures would be in the range of thirteen hundred to fifteen hundred degrees fahrenheit. This required the use of special high temperature alloys, and high efficiency fuels. In addition it was essential to ensure that there was adequate oxygen in the gases being exhausted to maintain efficient levels of combustion in the afterburner.

In some cases it was possible to recover part of the heat created by the stack afterburner, but often such heating values represented a total waste in the system.

In many cases however it is not necessary to provide this extreme degree of treatment of solvent vapours. This is particularly true in the case of retro fit installations where an old inefficient plant is simply being upgraded.

In addition the cost in terms of fuel consumption, required for this extreme treatment, may be greater than any savings, and in areas where fuel is scarce this factor may rule out the use of an exhaust stack afterburner altogether.

In accordance with the present invention, all solvent laden gases generated in the oven whether from the high solvent release zones or not, are passed through zone incinerators within the oven, with the zone incinerators discharging the incinerated gases directly into their respective zones. Separation between zones of low and high solvent release is maintained by inducing a slight "migration" of oven gases from the low solvent to the high solvent zones. Fresh air, sufficient to maintain combustion in the incinerators is inducted into the oven, by exhausting oven atmosphere from the last one quarter to one third of the oven, where only a negligible portion of the solvent is released. The exhaust gas is discharged through the stack substantially free of untreated solvents without further incineration. No stack afterburner is required. In this way the calorific value of the solvent is released within the oven.

BRIEF SUMMARY OF THE INVENTION

The invention therefore comprises a method of operating a strip curing oven for curing a solvent based coating on a strip passing therethrough and comprising passing the strip continuously through sequential oven zones, continuously circulating hot gases in each said zone separately to vapourize solvents in said coating and entrain them in such gases within respective said zones and cure said coating, said solvents being released in high volume in at at least one of said zones, and being released in low volume in another of said zones, continuously incinerating some of said gases in said zones in respective zone incinerators to oxidize solvent vapours therein and returning same directly to said zones, continuously extracting some solvent rich gases without incineration from said high release zone and transferring them to said zone incinerator of at least one other said zone of low solvent release and incinerating said solvent rich gases therein to oxidize said solvent vapours and discharging high temperature combustion gases in said at least one zone thereby supplying at least part of the heat requirement for said zone and maintaining same substantially free of solvent vapours, continuously extracting some of said gases from said low solvent release zone and introducing them into said high solvent release zone to replace a portion only of said solvent rich gas transfer, the balance to replace said solvent rich gas transfer being made up by migration of zone gases within said oven, from a low solvent release zone, whereby to prevent migration of solvent rich gases from said high solvent zone to zones of lower solvent release, continuously introducing fresh air to maintain efficient incineration of said solvent vapours, and, continuously extracting some of said solvent free gases from at least one said zone of low solvent release and exhausting them directly to atmosphere without incineration.

The invention further comprises the apparatus carrying the aforesaid method and comprising an oven means comprising a plurality of oven zones through which the strip passes in sequence, a plurality of zone incinerators in at least some of said zones, said zone incinerators being operable to receive gases from within their respective such zone, and incinerate the same and discharge them directly back onto said zone, oven gas circulating means for continuously circulating heated gases above and below the strip, whereby to vapourize solvents contained in said coating, and cure said coating, said zone incinerators continuously subjecting some of such solvent vapours to incineration within each said zone, zone gas transfer duct means connected so as to withdraw at least some zone gases from the upstream zones of said oven, and transfer them to zone incinerators in downstream said zones, zone gas transfer means connected to withdraw at least some zone gases from said downstream zone and transfer them back to said upstream zones for mixture with zone gases therein, and oven gas exhaust means connected to withdraw zone gases from said downstream zones, and vent the same directly to atmosphere without further treatment.

Preferably, the method and apparatus according to the invention will be carried out in an oven having typically four such zones, with first and second zones being the areas of high solvent release and third and fourth zones being the areas of lower or no solvent release, and with the zone gas transfer means being connected to withdraw atmosphere from between the first and second zones and transfer them directly back into the incinerators of the second, third and fourth zones.

Preferably, there would be further gas transfer means extracting zone atmosphere from the leading end of the first zone and transferring it to the incinerator in the first zone, whereby to further incinerate solvent vapours in the first zone.

Preferably, the exhaust means will be connected so as to withdraw part of the atmosphere of the fourth zone and part of the atmosphere of the third zone, being substantially solvent free atmosphere, and vent the same directly to atmosphere.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a schematic plan view showing a strip coating oven according to the invention.

DESCRIPTION OF A SPECIFIC EMBODIMENT

Figure 1:
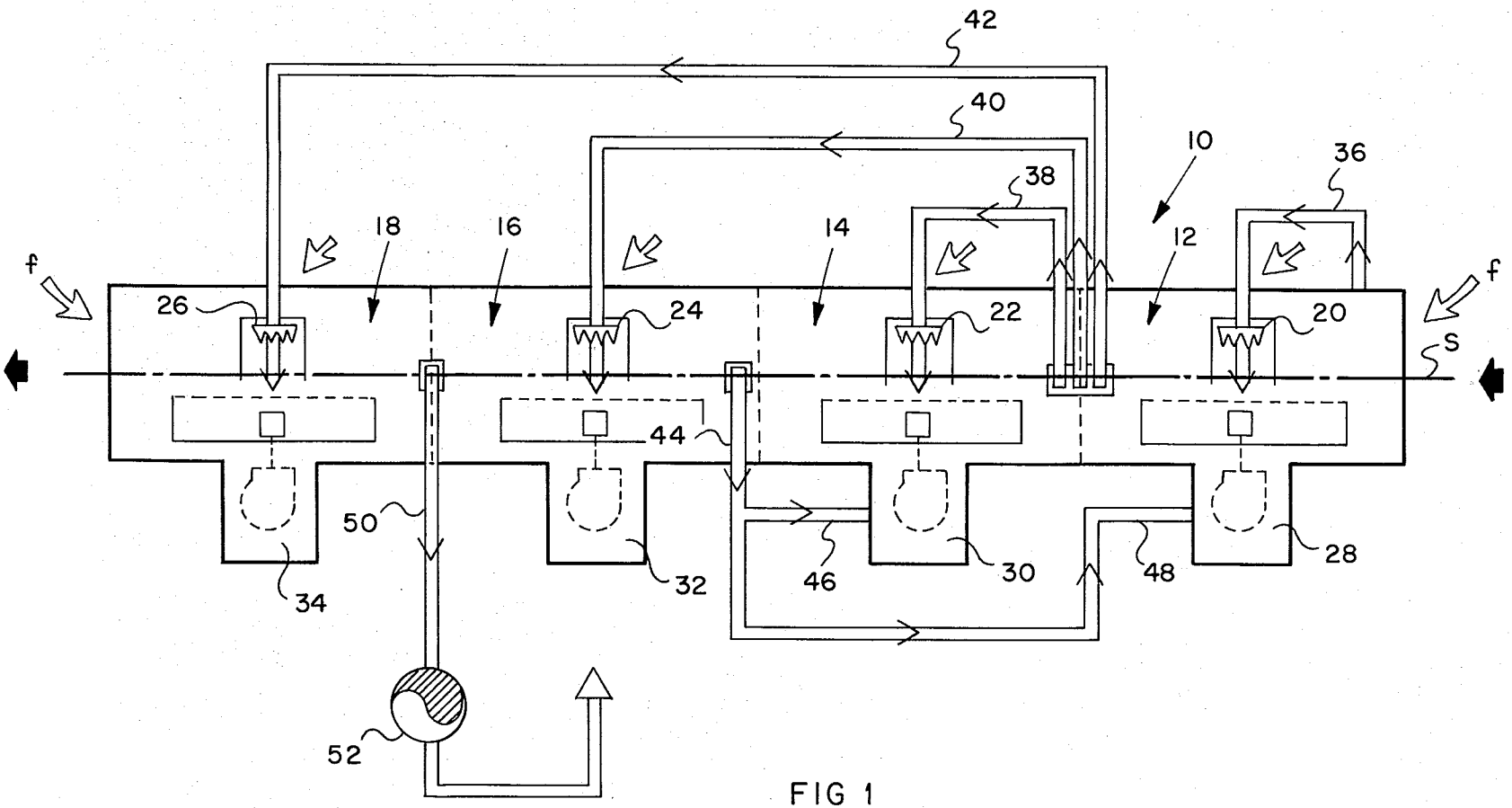

Referring now to FIG. 1, it will be noted that the oven according to the invention is illustrated generally as 10. Such ovens may be constructed in a variety of ways, the details of which are irrelevant for the purposes of the invention. In the majority of cases they will be divided into a plurality of oven zones. In this case four such zones are shown although a greater or lesser number of zones may be provided.

For the purposes of the present invention, however, the oven 10 is divided into first, second, third and fourth zones identified as 12, 14, 16 and 18 in the drawings, being separated by chain dotted lines merely for the purposes of explanation.

The oven is in most cases a continuous structure, without physical barriers between adjacent zones, but the actual zone gases in each zone are circulated separately, and in accordance with the invention they are not permitted to mix indiscriminately with zone gases in adjacent zones.

The coated strip is shown schematically as S, and enters through a suitable opening (not shown) in the oven of the leading end of zone 10 and exits through a similar opening (not shown) of the trailing end of zone 18.

Typically, the strip S will hang in a catenary through the oven, free of any support other than rollers (not shown) at either end. For the purposes of the present explanation, however, the strip is shown in a straight line for simplicity sake only.

Typically, such a strip will first have been coated on one or both sides in a coater installation, of which various types are known in the art and require no further description.

Each of the zones is provided with a zone incinerator and fan indicated respectively as 20, 22, 24 and 26. Such zone incinerator may be manufactured as shown for example in copending U.S. Application Ser. No. 732,165, filed Oct. 13, 1976, now U.S. Pat. No. 4,140,467, and entitled Convection Oven and Method of Drying Solvents.

Essentially the zone incinerators each function so as to cycle a portion of the zone gases or atmosphere through the incinerator continuously, and the solvent vapours contained in such zone gases will be incinerated and returned through the incinerator back to oven as oven atmosphere.

The incinerator may incorporate respective air inlets for fresh air if required to maintain efficient combustion.

In addition, each of the zones is provided with a continuous zone atmosphere circulation system indicated generally as 28, 30, 32 and 34. Such circulation systems are well known in the art and may be constructed as shown for example in the U.S. Patent Application referred to aforesaid.

Such circulation systems consist essentially of separate duct work in each zone arranged above and beneath the path of the strip, and separate circulation fan means in each zone, for continuously cycling zone atmosphere through the fan and into the duct work so that it is passed in a continuous turbulent gas flow over and under the strip.

The circulation duct work in each zone is separate from the other zones and ensures that zone gases are confined substantially within respective zones notwithstanding the absence of physical barriers between the zones. Migration of zone gases from one zone to another is controlled in accordance with the invention.

Additional zone gas heaters (not shown) may be provided in each of the zones if desired, for providing make up heating for these zone gases, such zone heaters being well known in the art and are omitted for the sake of clarity.

A zone gas transfer duct 36 is provided connected to the upstream end of zone 12 and transferring oven atmosphere therefrom into zone incinerator 20 from whence it will be incinerated and returned directly back to zone 12 as oven atmosphere. Further zone gas transfer ducts 30, 40 and 42 are provided. Each of such ducts is connected so as to withdraw zone gases from the area of transition between zones 12 and 14. Duct 38 then transfers its portion of such gases directly back to the incinerator 22 of zone 14. Duct 40 transfers its portion of the zone gases directly to zone incinerator 24 in zone 16, and duct 42 transfers its portion of the zone gases directly to incinerator 26 of zone 18. In each case the transferred gases will be rich in solvent vapours and are therefore passed directly through the respective zone incinerators so as to incinerate such solvents and oxidize same after which the incinerated gases are mixed with zone gases circulating in their respective zones. In this way a substantial portion if not all of the heat required for each zone is provided by the combined operation of its respective zone incinerator together with the heating values contained in the solvent vapours.

In order to make up a portion of the zone atmosphere from zones 12 and 14 which is transferred downstream, an upstream transfer is provided by means of duct 44, which is branched to connect with ducts 46 and 48 connecting with the oven gas circulation systems 28 and 30 of zones 12 and 14.

Preferably, as shown the duct 44 is connected so as to extract zone gases from the leading end of the zone 16.

A proportion of the oven gases are withdrawn and vented to atmosphere by means of an exhaust stack duct 50 and fan 52, which is then connected directly to atmosphere without passing through any further incineration or treatment.

Such fresh air as is required in the system is admitted at either end around the entry and exit openings for the strip S.

Clearly, fuel supplies will be provided for the various zone incinerators, and various temperature controls and regulators will also be provided such as are well known in the art and will require no further description.

In operation, after the initial start up of the oven, the continuous substantially steady state operation of the oven will be as follows:

In zone 12, a large portion of the solvent vapours present in the coating will be evapourated, by the rapid turbulent circulation of zone gases caused by the circulation system 28. The major portion of the solvent vapours in the whole oven will in fact be given off in zone 12. Accordingly, zone gases from zone 12 are subjected to the greatest degree of incineration. This is achieved by means of extracting a portion of the zone gases through duct 36 and continuously cycling them back into the zone through incinerator 20 thereby oxidizing solvent vapours and returning them to the zone as zone atmosphere. Additonal volumes of gases from zone 12 are extracted through duct 38, 40 and 42 and are incinerated in downstream zones.

Substantial volumes of solvent vapours may also be developed at least in the first half of zone 14, by a similar circulation of hot oven gases by means of circulation system 30. Accordingly, substantial volumes of such zone gases from zone 14 are extracted by means of ducts 38, 40 and 42, some of such zone gases being cycled directly back through duct 38 and incinerator 22 into zone 14, and the remainder being transferred to downstream zones for incineration.

In zone 16 little or no solvent vapours will be evapourated, and the same is also true in zone 18 so that the zone atmosphere in zones 16 and 18 is substantially solvent free, the coating at this point being simply subjected to further curing time in the oven. The temperature in zones 12, 14, 16 and 18 may vary so that there is a gradual increase in temperature from the upstream to the downstream end of the oven. In this way, the initial volumes of solvent vapours in the coating are evapourated without over heating or damaging the coating, after which the curing of the coating can be progressively accelerated by increasing the temperatures.

In order to balance the downstream transfer of solvent rich gases, substantially solvent free gases are transferred upstream by means of continuously extracting portions of the atmosphere at least of zone 16 through duct 44 and transferring it into the circulation systems 28 and 30 in zones 12 and 14. In this way additional virtually solvent free zone ventilation gases are provided to replace a portion of the high solvent gases transferred from the zones of high solvent release.

Such upstream transfer in duct 44 is maintained at a level which is always insufficient to replace the downstream transfer. This ensures that there will always be a slight upstream migration of zone gases from zones 16 and 18 of low solvent release, into the high solvent release zones 12 and 14. The purpose of this is to prevent any possible downstream migration of high solvent gases. If such downstream migration took place it would tend to contaminate the gases in the low solvent zones. If these low solvent gases became contaminated by high solvent gases, then it would become essential to use an exhaust stack afterburner, and the advantages of the invention would be lost.

The zone atmospheres in zones 16 and 18 being substantially solvent free, can be extracted through exhaust stack duct 50 by means of fan 52 and vented directly to atmosphere without treatment. The location of the exhaust stack duct 50 in the downstream location, ensures that no solvent vapours from for example zones 12 and 14 can be inadvertently vented to atmosphere untreated. In addition, it permits the venting of such solvent free gases directly to atmosphere without having to pass through an exhaust stack afterburner as was previously the case.

Fresh air is continuously admitted at either end of the oven as required to maintain efficient incineration of the solvent vapour, and to replace gases exhausted to atmosphere. Air may also be admitted at the zone incinerators.

Typical zone temperatures may be zone 12, 500° F., zone 14, 600° F., zone 16, 700°, zone 18, 800° F. The effective separation of the various zone atmospheres by means of the separate zone circulation systems also enables such temperature variations to be maintained. The temperatures given above are merely explanatory without limitations.

It will also be noted that all of the heating values generated in the oven are retained within the oven itself so that heat losses in the system are reduced to a minimum.

In addition, the temperature of the exhaust gases being vented to atmosphere will be substantially lower, ie. at or below the temperature of zones 16 and 18, whereas in the past the exhaust gases being vented after passage through the afterburner might well be at a very much higher temperature.

In this way it is possible to operate with lower temperature duct work and fans and controls making the whole installation more economical.

As a result of the lower incineration temperatures, the oxidation of solvent vapours is not as thorough as in the case of an exhaust afterburner. However it is found that at least 90% of solvent vapours will be oxidized within the oven.

For the purposes of this invention oven gases, containing 10% or less of untreated solvent vapours are considered to be "substantially solvent free gases", or to be substantially fully oxidized.

It will be seen from the above that the invention is particularly suitable as a "retrofit" improvement of an existing oven installation in which solvent vapours are either vented to atmosphere, or are treated in such a way that their heat values are lost. It will also be suitable for use in certain localities where fuel is scarce rendering the use of an exhaust afterburner undesirable.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A method of operating a strip curing oven for curing a solvent based coating on a strip passing therethrough, and comprising;

passing said strip continuously through sequential oven zones;

continuously circulating hot gases separately in respective said zones to vapourize solvents in said coating and entrain them in such gases within respective said zones and cure said coatings; said solvents being released in high volume in at least one zone of high solvent release, and being released in low volume in at least one zone of low solvent release;

continuously incinerating some of said gases in said zones to oxidize solvent vapours therein and returning same directly to respective said zones;

continuously extracting some solvent rich gases without incineration from said high solvent release zone and distributing them to incinerators at other said zones;

continuously incinerating said solvent rich gases in said other zones to oxidize said solvent vapours and discharging substantially solvent free incinerated gases at an elevated temperature into said other zones for mixture with zone gases thereby supplying at least part of the heat requirement for said other zones with high temperature gases substantially free of solvent vapours;

continuously extracting some of said gases from some said other zones and introducing them into said high solvent release zone to replace a portion of said solvent rich gases transferred therefrom;

continuously replacing a further portion of the volume of said solvent rich gas transfer by migration of zone gases within said oven from a zone of low solvent release to a zone of high solvent release thereby preventing downstream migration of high solvent gases into zones of low solvent release;

continuously introducing fresh air to maintain efficient incineration of said solvent vapours, and, continuously extracting some of said solvent free gases from said zone of low solvent release and exhausting them directly to atmosphere without incineration.

2. The method as claimed in claim 1 including the step of introducing said fresh air at each end of said oven in response to extraction of solvent free gases from said low solvent release zone, thereby reducing escape of oven gases at the ends of the oven.

3. The method as claimed in claim 2 whereby said oven includes first, second and third oven zones each having zone incinerators, and including the steps of continuously extracting solvent rich gases from said first and second zones, and reintroducing at least some such gases into said second and third zones through respective said second and third zone incinerators.

4. The method as claimed in claim 3 including a fourth oven zone and zone incinerator and including the step of continuously reintroducing some of said solvent rich gases through said incinerator into said fourth oven zone.

5. The method as claimed in claim 4 including the step of extracting said solvent free gases from said second, third and fourth oven zones.

6. The method as claimed in claim 5 including the step of extracting a portion of said gases from said second and third zones, and reintroducing them back into said first and second zones.

7. The method as claimed in claim 6 including the step of continuously introducing portions of fresh air at said zone incinerators whereby to promote efficient combustion in said incinerators.

* * * * *